US005100301A

United States Patent [19]

Hidaka et al.

[11] Patent Number: 5,100,301

[45] Date of Patent: Mar. 31, 1992

[54] WOBBLE PLATE TYPE REFRIGERANT COMPRESSOR PROVIDED WITH AN INTERNAL ROTATION DETECTOR GENERATING A SIGNAL HAVING A SYMMETRICAL WAVE FORM

[75] Inventors: Shigeyuki Hidaka; Soukichi Hibino; Toru Takeichi; Masaki Ohta, all of Kariya, Japan

[73] Assignee: Kabushiki Kaisha Toyoda Jidoshokki Seisakusho, Kariya, Japan

[21] Appl. No.: 717,989

[22] Filed: Jun. 20, 1991

[30] Foreign Application Priority Data

Jul. 5, 1990 [JP] Japan ..... 2-71967[U]

[51] Int. Cl.[5] ..... F04B 1/28

[52] U.S. Cl. ..... 417/222 S; 417/269

[58] Field of Search ..... 417/222 S, 222 R, 269

[56] References Cited

U.S. PATENT DOCUMENTS

| | | | |
|---|---|---|---|
| 4,355,959 | 10/1982 | Kono et al. | 417/223 |
| 4,393,966 | 7/1983 | Kono et al. | 417/269 X |
| 4,480,961 | 11/1984 | Kono et al. | 417/269 X |
| 4,701,109 | 10/1987 | Daikohara | 417/269 X |
| 4,737,079 | 4/1988 | Kurosawa et al. | 417/222 S |
| 4,781,538 | 11/1988 | Daikohara | 417/223 |
| 4,822,252 | 4/1989 | Ishikawa et al. | 417/222 S |
| 5,022,826 | 6/1991 | Matsuda et al. | 417/222 R |
| 5,046,927 | 9/1991 | Ohno et al. | 417/222 S |
| 5,059,097 | 10/1991 | Okazaki | 417/222 S |

*Primary Examiner*—Leonard E. Smith

*Attorney, Agent, or Firm*—Brooks Haidt Haffner & Delahunty

[57] ABSTRACT

A variable capacity wobble plate type compressor having an electromagnetic induction type rotation detector detecting an actual rotation of internal rotatable elements in the compressor, which has a flanged disc-like element having apertures formed in the flange of the element and attached to a drive plate support element rotatable with a drive shaft of the compressor and an electromagnetic induction type sensing element cooperable with the apertures of the flanged disc-like element to generate an electric voltage signal having a wave form having symmetrical peak absolute values of different polarities with reference to a reference voltage level and in no way influenced by the existence of a partial balancing rom portion of the drive plate support element.

6 Claims, 5 Drawing Sheets

WOBBLE PLATE TYPE REFRIGERANT COMPRESSOR PROVIDED WITH AN INTERNAL ROTATION DETECTOR GENERATING A SIGNAL HAVING A SYMMETRICAL WAVE FORM

BACKGROUND OF THE INVENTION

1. Field of the Invention

The present invention relates to a variable capacity wobble plate type refrigerant compressor, and more particularly, to a rotation sensing system enabling an accurate detection of a rotation of the internal compressing mechanism of the variable capacity wobble plate type refrigerant compressor.

2. Description of the Related Art

The variable capacity wobble plate type refrigerant compressor includes a cylinder block, an open-ended rear housing having suction and discharge chambers therein and connected to an end of the cylinder block, an open-ended crankcase having a crank chamber therein and connected to the other end of the cylinder block, an axial drive shaft extending through the crankcase and the cylinder block to be rotatable about a longitudinal axis thereof, a reciprocatory piston mechanism provided in the cylinder block for carrying out a pumping-in of a refrigerant gas before compression, a compression of the refrigerant gas, and a delivery of the compressed refrigerant gas, and an assembly of a non-rotatable wobble plate and a rotatable drive plate arranged in the crank chamber for reciprocating the pistons of the piston mechanism via piston rods in response to a rotation of the drive plate. The assembly of the non-rotatable wobble plate and rotatable drive plate is supported on a support element fixedly mounted on the drive shaft and rotated therewith.

The support element mounted on the drive shaft is formed as a generally circular element having a circular base portion, and is supported by an inner wall of the crankcase via a thrust bearing having a pair of axially confronting race members enabling a plurality of roller members to rotate therebetween. The base portion of the support element is provided with a central bored boss by which the element is mounted on the drive shaft, a radially projected arm to which the drive plate is pivotably connected via a pivoting pin, and a partial rim portion allowing the drive plate to perform a dynamically balanced rotation and wobbling when driven by the drive shaft. The partial rim of the support element is circularly extended around a part of the base portion, and is provided with a diameter larger than that of the base portion.

The variable capacity wobble plate type refrigerant compressor is further provided with an electro-magnetic induction type rotation detector for detecting a rotation of internal elements of the compressor, i.e., the support element, and the assembly of the drive and wobble plates. A typical rotation detector for a refrigerant compressor having a swash plate type conversion mechanism for converting a rotation of a drive shaft into a reciprocatory compressing motion of pistons is disclosed in e.g., U.S. Pat. No. 4,462,491 to Kono et al. The rotation detector of U.S. Pat. No. 4,462,491 includes an electromagnetic induction type sensing element having a bar magnet, and an electric coil enclosing the bar magnet and generating an electric signal in cooperation with a rotating sensed element.

The other conventional rotation detector for a wobble plate type compressor includes a mechanical projection formed in one of the above-mentioned metallic race members of the thrust bearing, i.e., the race member fixed to the support element, and a stationary sensing element generating a detecting signal when electromagnetically sensing the projection rotated with the support element. The projection of the race member is arranged at a position on the borders of the smaller base portion and the larger partial rim portion of the support element to generate an electric signal at each complete revolution of the support element. The projection is bent at about a right angle in such a manner that a bent portion thereof is radially located outside the outer circumference of the base portion of the support element, to function as a sensed portion electromagnetically cooperating with the stationary sensing element to thereby produce the detecting signal in the form of an electric voltage signal indicating that the internal elements of the compressor are actually rotated.

The wave form of the electric voltage signal of the rotation detector shows plus and minus different polarities in response to a change in the positional relationship between the sensed portion of the projection and the stationary sensing element, i.e., a movement of the sensed portion approaching an exact opposing position where it is in registration with the stationary sensing element, and the other movement of the sensed portion moving away from the exact opposing position, produce a change in the polarity of the electric voltage signal of the sensing element. Also, the absolute values of the electric voltage signal are greatly different from one another when the polarity of the signal is different. Namely, during the rotation of the support element, when the sensed portion of the projection, preceded by a portion of the outer circumference of the smaller base portion of the element, passes the stationary sensing element, the electric voltage signal exerted by the sensing element has a large absolute value. Nevertheless, during the rotation of the support element, when a portion of the outer circumference of the larger rim portion of the element, preceded by the sensed portion of the projection, passes the sensing element, the absolute value of the electric voltage signal become small. Therefore, the wave form of the electric voltage signal of the rotation detector of the conventional wobble plate type refrigerant compressor is not symmetrical to a reference level, i.e., a zero voltage level, and accordingly, such an asymmetry of the electric voltage signal of the rotation detector makes it difficult to establish a proper reference level of the signal during the electronic processing thereof in the later stage of determining whether or not the internal element in the compressor is actually rotated. As a result, it is impossible to expect an accurate detection of the rotation by the rotation detector of the conventional compressor. In this connection, one method of solving the asymmetry problem of the rotation detecting signal can be taken in which the sensed portion of the projection is shifted radially outward with respect to the outer circumference of the larger rim portion of the support element, so that an approximately equal electro-magnetic induction principle appears on both sides of the sensed portion of the projection in relation to the sensing element. Nevertheless, the method of shifting the projection outward causes a problem of an increase of an outer diameter of the compressor per se.

SUMMARY OF THE INVENTION

Therefore, an object of the present invention is to obviate the defects encountered by the rotation detector of the conventional variable capacity wobble plate type refrigerant compressor.

Another object of the present invention is to provide a variable capacity wobble plate type refrigerant compressor provided with a rotation detector therein which is able to generate a rotation detecting electric voltage signal having the waveform in which the plus and minus polarity portions are symmetrical with reference to the zero voltage level to thereby permit an accurate detection of the rotation of internal elements of the compressor without the need for an increase in the diametrical size of the compressor per se.

In accordance with the present invention, there is provided a variable capacity wobble plate type refrigerant compressor, which comprises:

a housing having therein a suction chamber for a refrigerant to be compressed and a discharge chamber for a compressed refrigerant, a cylinder block having therein a plurality of cylinder bores in which reciprocatory pistons are disposed to pump in the refrigerant from the suction chamber and then to discharge the refrigerant after compression to the discharge chamber, a crankcase connected to the cylinder block and defining a crank chamber therein receiving therein a drive shaft axially extending through an inner end wall of the crankcase;

a generally circular support element mounted on the axial drive shaft to be rotatable with the drive shaft, and having a base disc portion having a predetermined diameter, a support arm radially projecting from the base disc portion into the crank chamber, and a partial balancing rim portion in the form of a partial circular extension provided for a part of an outer circumference of the base disc portion to have a diameter larger than the predetermined diameter of the base disc portion;

a first thrust bearing arranged between the inner end wall of the crankcase and the support element for supporting the support element;

a rotary drive plate pivotally connected to the support arm of the support element to be rotatable with the support arm and capable of changing an inclination thereof with reference to a plane perpendicular to an axis of the axial drive shaft;

a non-rotatable wobble plate held by the rotatable drive plate via a second thrust bearing so as to change an inclination thereof with the drive plate, the wobble plate being operatively connected to the reciprocatory pistons via piston rods to cause a reciprocatory compressing motion of the pistons;

a control valve means for regulating a pressure level in the crank chamber with respect to a suction pressure prevailing in the suction chamber of the housing so as to control a pressure differential between the pressure in the crank chamber and the suction pressure to thereby regulate the inclination of the wobble plate; and a rotation detector for generating an electric signal indicating that internal elements of the compressor including the support element, and the rotary drive plate are rotated by the drive shaft, the rotation detector comprising:

a flanged disc-like sensed element arranged between the inner end wall of the crankcase and the support element, the sensed element being provided with a disc portion having a diameter larger than that of the partial balancing rim portion of the support element, and a flange extending axially from an outer periphery of the disc portion to thereby enclose the support element, the flange of the sensed element being formed therein with apertures, each being arranged to be located at a position other than that lying on an outer periphery of the partial balancing rim portion of the support element; and a sensing element arranged at a fixed position adjacent to the surface of the flanged disc-like sensed element enclosing the support element and cooperating with the sensed element for generating a rotation detecting signal when the apertures of the sensed element passes the sensing element.

BRIEF DESCRIPTION OF THE DRAWINGS

The above and other objects, features and advantages of the present invention will be made more apparent from the ensuing description of preferred embodiments of the present invention with reference to the accompanying drawings wherein.

DESCRIPTION THE PREFERRED EMBODIMENTS

Figure 1:
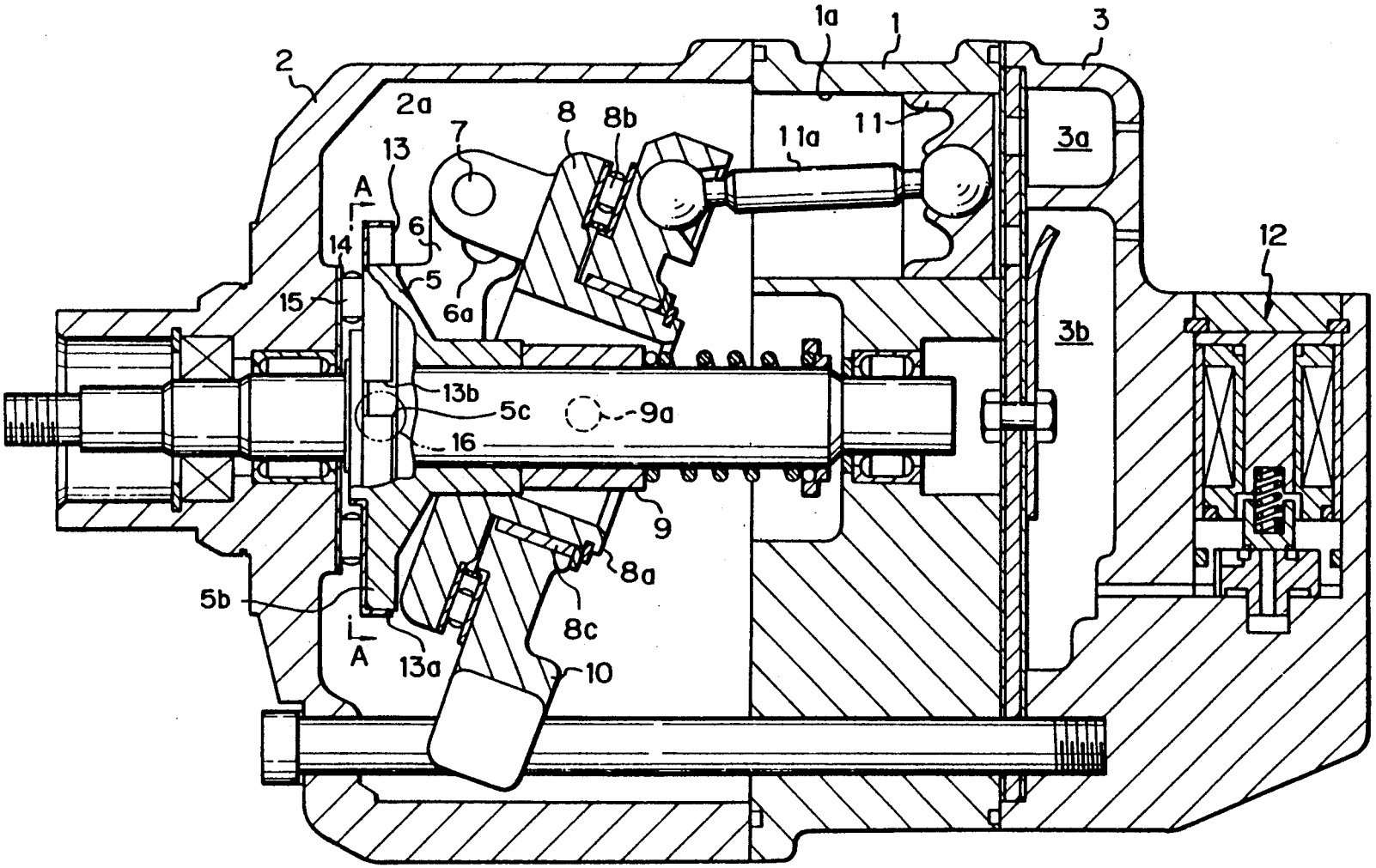
FIG. 1 is a longitudinal cross-sectional view of a variable capacity wobble plate type compressor according to the present invention, illustrating an internal elements thereof.

Referring to FIGS. 1 through 4, a variable capacity wobble plate type refrigerant compressor is provided with a cylinder block 1 forming a part of the housing thereof, a front housing or crankcase 2 attached to a front end of the cylinder block 1, and a rear housing 3 attached to a rear end of the cylinder block 1. The attachment of the crankcase 2 and the rear housing 3 to the cylinder block 1 is achieved by a plurality of longitudinal bolts having a screw-threaded end (one such bolt is shown in FIG. 1 with no designation number). An axial drive shaft 4 is rotatably mounted in the cylinder block 1 and the crankcase 2 via a pair of front and rear radial bearings, and supports thereon a generally round support element 5 having an axially bored boss so that the support element 5 is rotated with the drive shaft 4 in the crankcase 2. Namely, the drive shaft 4 extends through a central bore 5*a* and the axial bore of the boss of the support element 5. The support element 5 is disposed at a position adjacent to an inner end of the crankcase 2, and is provided with a support arm 6 radially projecting from a base portion of the support element 6 in the chamber of the crankcase 2. The support arm 6 is provided with an elongated through-hole 6*a* formed in an end portion thereof to be slidably fitted with a pivoting pin 7 to which a drive plate 8 is pivotably and inclinably connected.

On the drive shaft 4 is slidably mounted a guide sleeve 9 at a position next to the end of the central boss of the support element 5. This guide sleeve 9 is provided with a pair of trunnion pins 9a radially laterally projecting therefrom at right angle to the axis of the drive shaft 4, and engaged in corresponding holes of the drive plate 8 to permit the drive plate 8 to be pivoted thereabout when the drive plate 8 is subjected to a change in an inclination thereof with regard to a plane perpendicular to the axis of the drive shaft 4. When the inclination of the drive plate 8 is changed, the movement of the drive plate 8 is smooth due to the slidable engagement of the elongated through-hole 6a and the pivoting pin 7, the sliding movement of the guide sleeve 9 on the drive shaft 4, and the pivotable engagement of the trunnion pins 9a and the drive plate 8.

Figure 3:
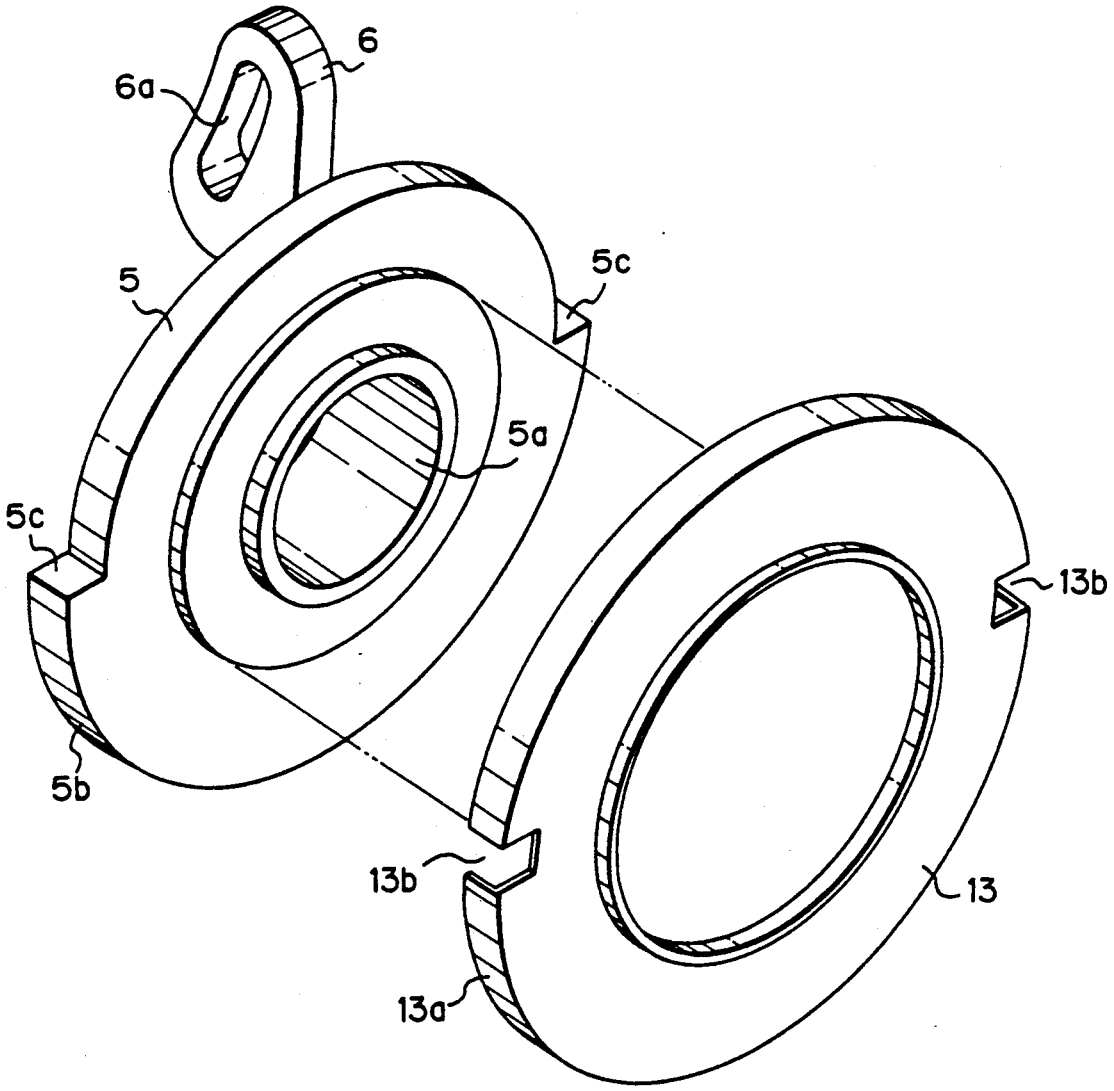
FIG. 3 is an enlarged perspective and exploded view of the support element and the sensed element of the compressor of FIG. 1.
Figure 4:
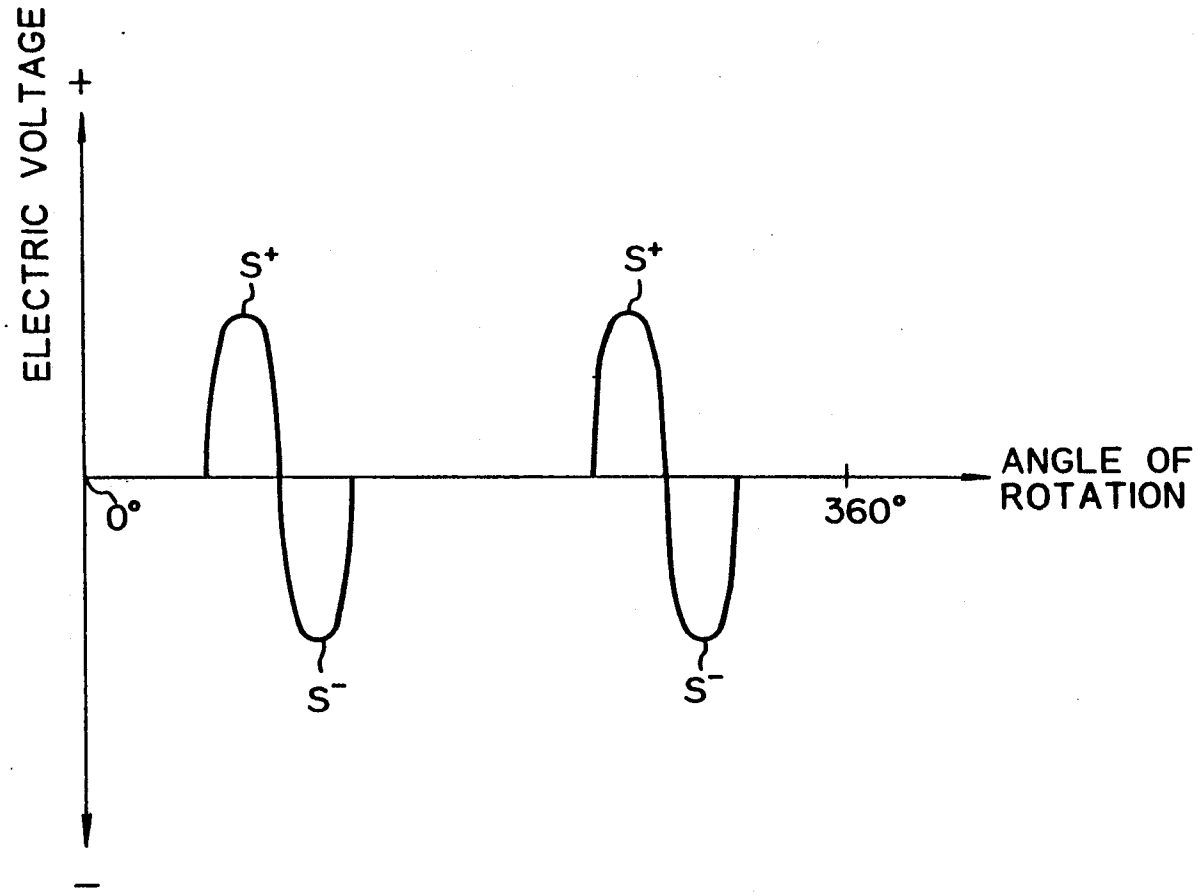
FIG. 4 is a graphical view illustrating an electric voltage signal generated by the rotation detector of the present invention.

As best shown in FIG. 3, the support element 5 in the form of a generally round element is provided with a partial rim portion 5b formed at a lower portion thereof for the balancing purpose as described with the support element of the conventional compressor. The partial rim portion 5b is extended to have a diameter larger than that of a remaining base portion of the element 5, and therefore a pair of steps 5c are formed between the partial rim portion 5b and the remaining small diameter base portion of the support element 5. In the preferred embodiment, the steps 5c of the support element 5 are circumferentially spaced approximately 180 degrees from one another.

A thrust bearing including a pair of thrust race members 13 and 14 and a plurality of roller elements 15 held between the race members 13 and 14 is disposed between the inner end of the crankcase 2 and the support element 5, and supports a thrust force acting thereon from pistons 11 via a wobble plate 10, the drive plate 8, and the support element 5, during the compressing operation of the compressor. The thrust race member 13 of the thrust bearing is fixed to the end of the support element 5, and the thrust race member 14 is fixed to the inner end wall of the crankcase 2.

Figure 2:
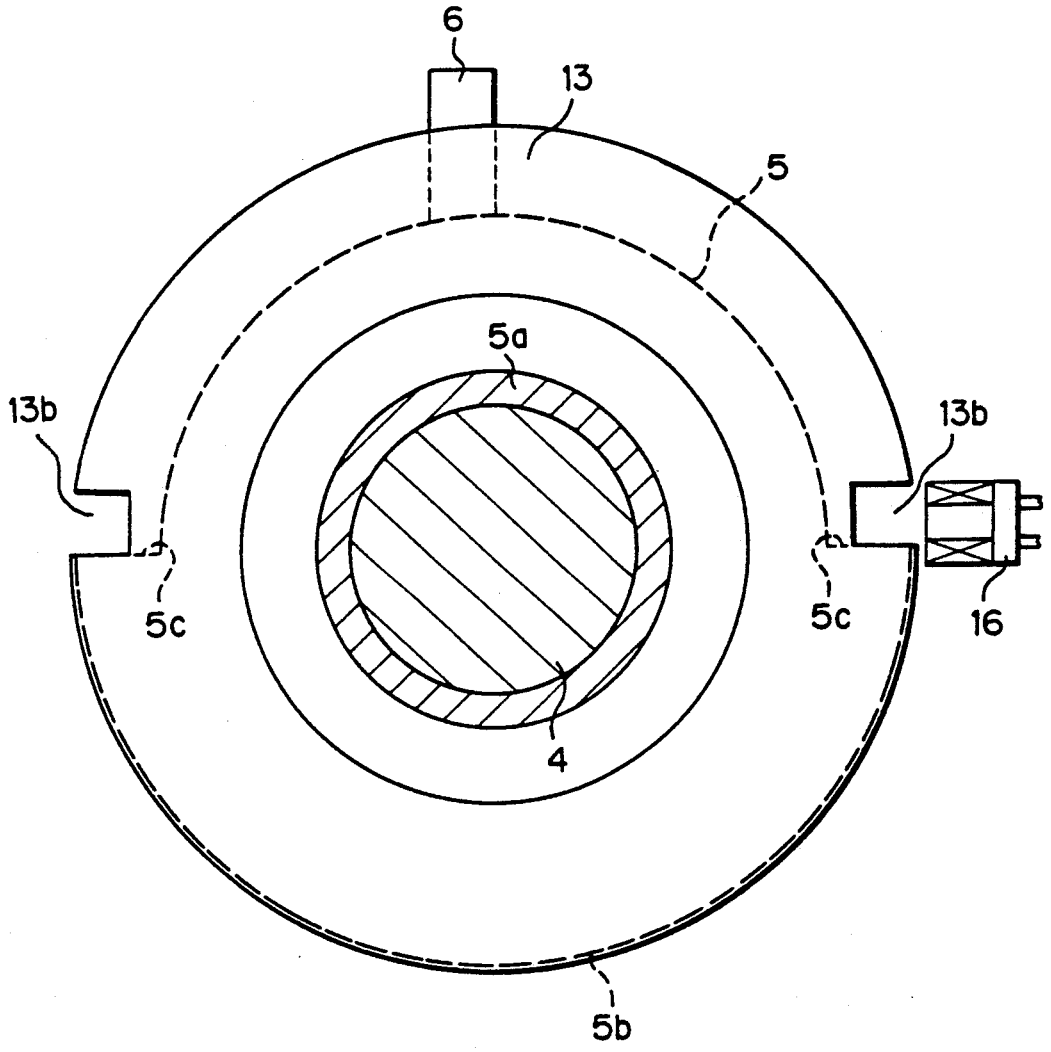
FIG. 2 is a view taken along the line A—A of FIG. 1, illustrating a front face of a disc-like sensed element of a rotation detector and an arrangement of a sensing element of a rotation detector accommodated in the compressor of FIG. 1.

In FIGS. 2 and 3, the thrust race member 13 of the thrust bearing is formed as a flanged race provided with a cylindrical flange 13a extending axially from the outermost periphery of the disc thereof. The cylindrical flange 13a has a diameter larger than that of the rim portion 5b of the support element 5 to be fitted on the support element 5. Namely, the flange 13a of the race member 13 envelopes the rim portion 5b of the support element 5 as shown best in FIG. 2. The flange 13a of the race member 13 is provided with a pair of apertures 13b formed by radially cutting deep into the disc of the race member 13. The apertures 13b are arranged to function as sensed portions to cooperate with a later-described electromagnetically sensing element of a rotation detector for detecting a rotation of the support element 5, and the two apertures 13b are circumferentially spaced approximately 180 degrees. As clearly shown in FIG. 2, when the race member 13 is fixed to the support element 5, each of the apertures 13b of the flange 13a is arranged at a position adjacent to one the steps 5c of the support element 5, and located to be radially spaced from the outer periphery of the smaller base portion of the support element 5. Namely, the apertures 13b do not lie on the outer circumference of the partial rim portion having a larger diameter.

In FIG. 1, the drive plate 8 is provided with a cylindrical boss portion 8a on which the wobble plate 10 is non-rotatably mounted via a thrust bearing 8b and a slide bearing 8c. The wobble plate 10 is thus able to wobble with the drive plate 8 in the crank chamber 2a of the crankcase 2 when the drive plate 8 is rotated by the drive shaft 4 via the support element 5. The wobble plate 10 is connected to the pistons 11 via piston rods 11a, and each of the piston rods 11a is provided with socket and ball joints provided on opposite ends thereof. The pistons 11 are arranged to be axially reciprocated in cylinder bores 1a of the cylinder block 1 to compress a refrigerant gas pumped in from a suction chamber 3a of the rear housing 3, and to deliver the compressed refrigerant gas toward a discharge chamber 3b of the rear housing 3.

Since the cylinder bores 1a of the cylinder block 1 are communicated the crank chamber 2a, the pistons 11 reciprocate in the cylinder bores 1a while changing the amount of stroke thereof in response to a change in a pressure difference between a suction pressure acting on rear ends of the pistons 11 and a crank chamber pressure acting on front ends of the pistons 11 during the operation of the compressor. The change in the amount of stroke of the pistons 11 causes a change in an amount of inclination of the wobble plate 10, with respect to the plane perpendicular to the axis of the drive shaft 4, to vary the compression capacity of the wobble plate type compressor. A pressure level of the crank chamber pressure in the crank chamber 2a is regulated by a solenoid-operated type control valve 12 arranged in an rear extension of the rear housing 3.

As shown in FIG. 1, an electromagnetic sensing element 16 of the rotation detector is arranged on a lateral side of the support element 5 to cooperate with the afore-mentioned apertures 13b of the race member 13 for detecting the rotation of the support element 5. Namely, when the support element 5 is rotated, and when one of the apertures 13b of the race member 13 passes the sensing element 16 of the rotation detector, the sensing element 16 generates an electric voltage signal having two peak values S+ and S− shown in FIG. 4, on the basis of the electromagnetic induction principle, and the electric voltage signal appears twice for one complete rotation of the support element 5 due to an existence of the two apertures 13b.

At this stage, when consideration is given to the process of passing of each of the apertures 13b through a position in an exact registration with the sensing element 16 due to the rotation of the support element 5, it is understood that the aperture 13b passes that exact registration position while being preceded by a part of the surface of the flange 13a of the race member 13, and after the passing of the aperture 13b through that position, another part of the surface of the flange 13a of the race member 13 appears. Since every part of the surface of the flange 13a of the race member 13, except for the two apertures 13b, has an equal outer diameter, a constant radial distance is established between the surface of the flange 13a and the sensing element 16 as an effective distance from the view point of the electromagnetic induction principle, and when each aperture 13b passes the position in exact registration with the sensing element 16, a longer effective distance is established between the sensing element 16 and the surface of the smaller base portion of the support element 5. Therefore, the two peak absolute values S+ and S− of the rotation detecting signal generated by the sensing element 13 can be equal. That is, the wave form of the electric voltage signal indicating a detection of the rotation of the support element 5 can be symmetrical with reference to a reference level, i.e., zero voltage level, and accordingly when this symmetrical signal is processed at a later electric processing stage, a highly accurate detection of the rotation of the internal moving elements of the wobble plate type refrigerant compressor can be achieved.

Figure 5:
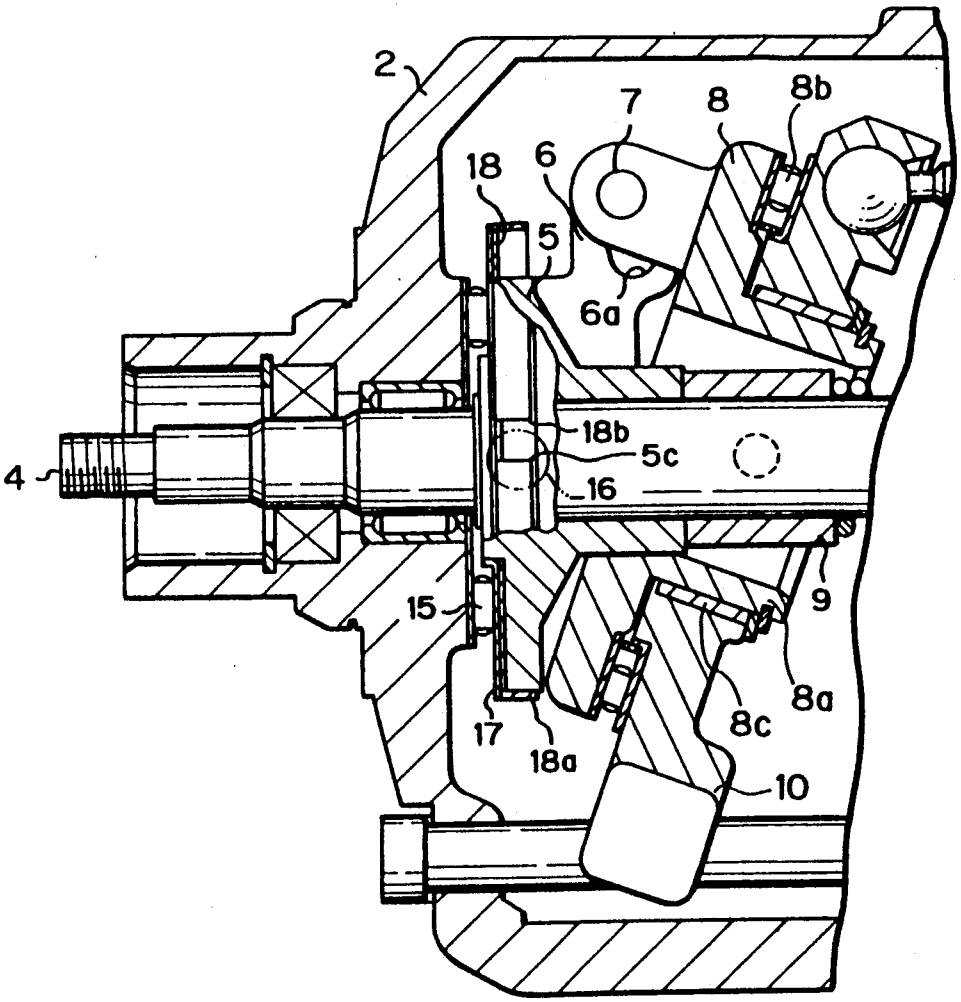
FIG. 5 is a partial cross-sectional view of a variable capacity wobble plate type compressor according to another embodiment of the present invention.

FIG. 5 illustrates another embodiment of the present invention. Namely, in the compressor of FIG. 5, a shim plate 18 is arranged between a non-flanged flat race member 17 and the support element 5 for adjusting a play of the thrust bearing between the support element 5 and the inner end wall of the crank case 2, and is provided with a flange 18*a* similar to the flange 13*a* of the flanged race member 13 of the first embodiment. Namely, the flange 18*a* of the shim plate 18 is provided with a pair of apertures 18*b* cooperable with the electromagnetic induction type sensing element 16 for detecting the rotation of the support element 5. The electric voltage signal generated by the sensing element 16 can exhibit a wave form thereof having symmetrical peak with absolute values of different polarities.

From the foregoing description, it will be understood that in accordance with the present invention, a rotation detector able to generate a rotation detecting signal from which an accurate detection whether or not internal movable elements of a variable capacity wobble plate type refrigerant compressor are actually rotated can be achieved.

We claim:

1. A variable capacity wobble plate type refrigerant compressor comprising:

a housing having therein a suction chamber for a refrigerant to be compressed and a discharge chamber for a compressed refrigerant, a cylinder block having therein a plurality of cylinder bores in which reciprocatory pistons are disposed to pump in the refrigerant from the suction chamber and then to discharge the refrigerant after compression to the discharge chamber, a crankcase connected to the cylinder block and defining a crank chamber therein receiving therein a drive shaft axially extending through an inner end wall of the crankcase;

a generally circular support element mounted on the axial drive shaft to be rotatable with the drive shaft, and having a base disc portion having a predetermined diameter, a support arm radially projecting from the base disc portion into the crank chamber, and a partial balancing rim portion in the form of a partial circular extension provided for a part of an outer circumference of the base disc portion to have a diameter larger than the predetermined diameter of the base disc portion;

a first thrust bearing arranged between the inner end wall of the crankcase and the support element for supporting the support element;

a rotary drive plate pivotally connected to the support arm of the support element to be rotatable with the support arm and capable of changing an inclination thereof with reference to a plane perpendicular to an axis of the axial drive shaft;

a non-rotatable wobble plate held by the rotatable drive plate via a second thrust bearing so as to change an inclination thereof with the drive plate, the wobble plate being operatively connected to the reciprocatory pistons via piston rods to cause a reciprocatory compressing motion of the pistons;

a control valve means for regulating a pressure level in the crank chamber with respect to a suction pressure prevailing in the suction chamber of the housing so as to control a pressure differential between the pressure in the crank chamber and the suction pressure to thereby regulate the inclination of the wobble plate; and a rotation detector for generating an electric signal indicating that internal elements of the compressor including the support element, and the rotatory drive plate are rotated by the drive shaft, the rotation detector comprising:

a flanged disc-like sensed element arranged between the inner end wall of the crankcase and the support element, the sensed element being provided with a disc portion having a diameter larger than that of the partial balancing rim portion of the support element, and a flange extending axially from an outer periphery of the disc portion to thereby enclose the support element, the flange of the sensed element being formed therein with apertures, each being arranged to be located at a position other than that lying on an outer periphery of the partial balancing rim portion of the support element; and a sensing element arranged at a fixed position adjacent to the surface of the flanged disc-like sensed element enclosing the support element and cooperating with the sensed element for generating a rotation detecting signal when the apertures of the sensed element passes the sensing element.

2. A variable capacity wobble plate type refrigerant compressor according to claim 1, wherein said flanged disc-like sensed element comprises a race member of said thrust bearing arranged between said inner end wall of said crankcase and said support element.

3. A variable capacity wobble plate type refrigerant compressor according to claim 1, further comprising a disc-like thim plate arranged between said first thrust bearing and said support element for adjusting a play of said first thrust bearing, said thim plate functioning as said flanged disc-like sensed element.

4. A variable capacity wobble plate type refrigerant compressor according to claim 1, wherein said support element has a pair of steps formed between said base disc portion and said partial balancing rim portion, and wherein said apertures of said flange of said disc-like sensed element are arranged adjacent to said steps of said support element.

5. A variable capacity wobble plate type refrigerant compressor according to claim 4, wherein said steps of said support element are circumferentially spaced 180 degrees from one another.

6. A variable capacity wobble plate type refrigerant compressor according to claim 1, wherein said sensing element comprises an electromagnetical induction type sensing element generating an electric voltage signal when electromagnetically cooperating with said apertures of said flange of said support element.

* * * * *